US008437451B2

(12) United States Patent
Van Lemel et al.

(10) Patent No.: US 8,437,451 B2
(45) Date of Patent: May 7, 2013

(54) X-RAY SHUTTER ARRANGEMENT

(75) Inventors: Wilbert Alexander Van Lemel, Rijssen (NL); Jaap Boksem, Haaksbergen (NL)

(73) Assignee: PANalytical B.V., Almelo (NL)

( * ) Notice: Subject to any disclaimer, the term of this patent is extended or adjusted under 35 U.S.C. 154(b) by 311 days.

(21) Appl. No.: 13/005,229

(22) Filed: Jan. 12, 2011

(65) Prior Publication Data

US 2012/0177180 A1 Jul. 12, 2012

(51) Int. Cl.
*G21K 1/04* (2006.01)

(52) U.S. Cl.
USPC ..... 378/160; 378/70

(58) Field of Classification Search ..... 378/70, 378/160
See application file for complete search history.

(56) References Cited

U.S. PATENT DOCUMENTS 3,113,214 A * 12/1963 Furnas, Jr. ..... 378/160
4,592,083 A 5/1986 O'Brien
4,905,268 A 2/1990 Mattson et al.

* cited by examiner

*Primary Examiner* — Jurie Yun
(74) *Attorney, Agent, or Firm* — Leason Ellis LLP

(57) ABSTRACT

A shutter arrangement for an X-ray housing includes a shutter 10 for example of solid tantalum. In embodiments, the shutter has a through hole 22 and slides between a closed and an open position on the inner face of the X-ray housing, in the open position the through hole 22 aligns with an opening 8 in the housing.

20 Claims, 5 Drawing Sheets

X-RAY SHUTTER ARRANGEMENT

FIELD OF INVENTION

The invention relates to an X-ray shutter and apparatus including the X-ray shutter.

RELATED ART

X-ray equipment using an X-ray source, typically an X-ray tube, frequently includes the X-ray source inside a housing that is opaque to X-rays. Historically, lead has been used for the housing, frequently supported by a brass or aluminium construction, though brass alone is becoming more prevalent as the material for the housing. The housing has an opening to allow the X-ray beam generated by the X-ray source to pass through the housing for use, and a shutter may be arranged at the opening to close the opening to X-rays except when X-rays are required.

SUMMARY OF INVENTION

In a first aspect of the invention, there is provided a shutter arrangement, comprising:

an outlet port in an housing for allowing X-rays to pass through the outlet port from an inner face to an outer face of the X-ray housing, the X-ray housing being substantially opaque to X-rays; and a shutter movable between a blocking position adjacent to the outlet port where it blocks the outlet port and an open position where it allows X-rays to pass through the outlet port;

wherein the shutter is of tantalum, niobium or zirconium, or an alloy containing at least 80% of one of these elements and a further metal/element; and wherein the shutter is a block having a hole through the block, the hole being aligned with the outlet port when the shutter is in the open position to allow X-rays to pass through the hole and the shutter blocking the outlet port when the shutter is in the blocking position.

The use of a shutter in this form allows the shutter to cover the inner edge of the outlet port behind the shutter in use. This can reduce corrosion as will be explained in more detail below.

According to an second aspect of the invention, there is provided a shutter arrangement having an outlet port in an housing for allowing X-rays to pass through the outlet port from an inner face to an outer face of the X-ray housing, the X-ray housing being substantially opaque to X-rays; and a shutter movable on the inner face of the X-ray housing between a blocking position adjacent to the outlet port where it blocks the outlet port and an open position where it allows X-rays to pass through the outlet port, wherein the shutter is of tantalum, niobium or zirconium, or an alloy containing at least 80% of one of these elements and a further metal/element of atomic number above 26.

The inventors have realised that the arrangement of a shutter of tantalum on the interior face of the housing allows for greatly reduced corrosion.

In another aspect of the invention, there is provided X-ray diffraction apparatus having such shutter arrangements.

BRIEF DESCRIPTION OF THE DRAWINGS

For a better understanding of the invention embodiments will be described, purely by way of example, with reference to the accompanying drawings, in which.

The figures are purely schematic and not to scale. The same or like components may be included in more than one figure and the description relating thereto is not necessarily repeated.

DETAILED DESCRIPTION

Figure 1:
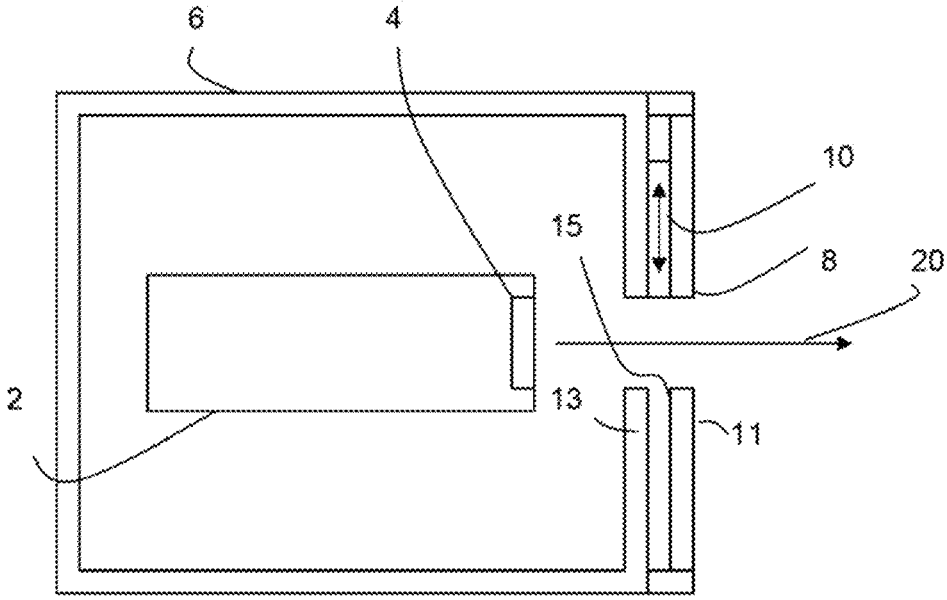
FIG. 1 shows a schematic diagram of an embodiment of the invention.

Referring to FIG. 1, an X-ray tube 2 has a window 4 at the end, the window 4 being typically made of beryllium to allow the X-rays 20 to pass out of the tube. The X-ray tube 2 is contained in a brass housing 6 which in turn has an opening 8 aligned with the window 4 to allow X-rays to pass out of the housing. The front face of the housing 6 has an outer member 11 and an inner member 13 and a shutter 10 moves between the inner and outer members 11,13 between an open position (shown in FIG. 1) in which the opening 8 is open and a closed position in which the shutter 10 blocks the opening.

Figure 2:
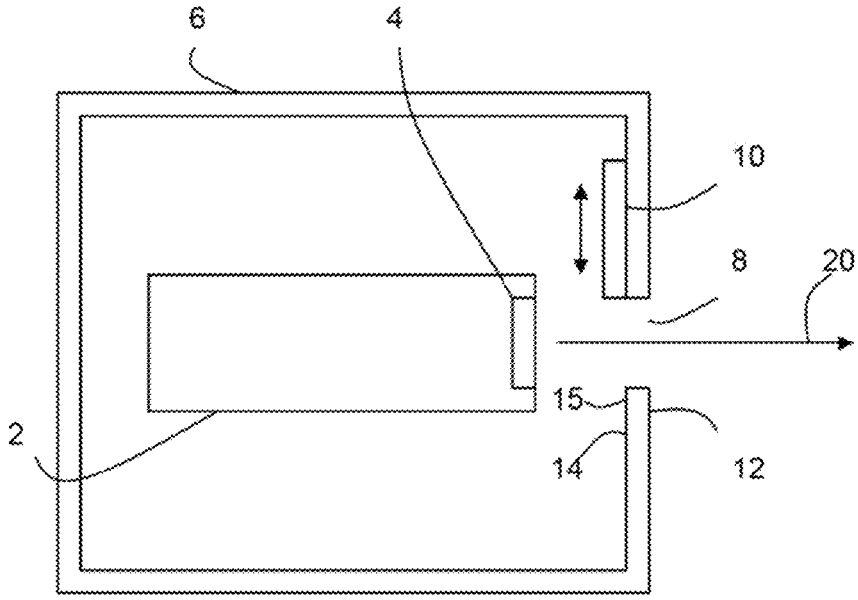
FIG. 2 shows a schematic diagram of an alternative embodiment of the invention.

Referring to FIG. 2, in an alternative approach, an X-ray tube 2 has a window 4 at the end, the window 4 being typically made of beryllium to allow the X-rays 20 to pass out of the tube. The X-ray tube 2 is contained in a brass housing 6 which in turn has an opening 8 aligned with the window 4 to allow X-rays to pass out of the housing. The front face of the housing 6 has an outer surface 12 and an inner surface 14. A shutter 10 is arranged to move on the inner face 14 of the housing between an open position (shown in FIG. 2) in which the opening 8 is open and a closed position in which the shutter 10 blocks the opening.

Corrosion of the shutters 10 in such arrangements is a significant problem. X-ray tubes can be used in a variety of locations, some of which can be damp, and therefore increasing corrosion.

Further, the inventors have realised that X-rays ionise air, together with the moist or damp in the air, nitric acid is formed, which can attack the shutter 10 or other shielding. Thus, the whole process of corrosion is not simply a question of conventional corrosion, but a physico-chemical process, especially where the ionisation level is the highest.

One approach to dealing with the corrosion is to cover the shutter in a coating, such as nickel, gold or similar, which resists corrosion. The inventors have realised that a problem with the use of such coatings is that the corrosion is not simply chemical corrosion but can also be caused by electrochemical corrosion when using two different metals with an electrochemical potential having a difference of greater than 0.1V—a battery effect can occur. It is almost impossible to avoid microscopic pin holes with such coatings, and this can then allow both electrochemical and physico-chemical corrosion to occur. The results obtained with such a shutter, namely a tungsten-copper (alloy) shutter coated with silver and gold, are presented below as a comparative example.

An alternative therefore might be to use a non-metallic shutter such as glass or ceramic. Unfortunately, most such materials are not sufficiently X-ray absorbing to function as a shutter.

The choice of a material for the shutter may alternatively be a corrosion resistant alloy such as Incoloy Alloy 825, a nickel-iron-chromium alloy with additions of molybdenum and copper. Incoloy Alloy 825 has proven satisfactory for X-ray corrosion resistance.

Unfortunately the element iron in Incoloy gives undesired iron X-Ray fluorescence which could affect the analytical performance in applications. A commonly used X-ray source uses a copper target which generates copper K-alpha X-ray radiation which has a high enough energy to enable iron fluorescence.

Further, iron has significant lower shielding properties (absorption of X-rays) as compared with tantalum or tungsten.

It should be noted that fluorescence in the region of the shutter contaminates the (pseudo-) monochromatic X-ray beam from the X-ray source and this gives rise to higher background radiation. Thus, in an X-ray diffraction apparatus, the measured diffractogram has a higher background. It is possible that the fluorescence also generates unexpected and unwanted diffraction peaks at other angles and this seriously impedes accurate measurement.

In the arrangement according to an embodiment the invention, the material of the shutter 10 consists of solid tantalum which has proven to give particularly good results and has a high enough atomic number that fluorescence is not a problem. The tantalum may be substantially pure, i.e. the shutter may consist essentially of tantalum. In alternative embodiments, small amounts of impurities may be present, preferably less than 2%, further preferably less than 1%. In particular, the amount of impurity may be sufficiently small that exposure to nitric acid does not cause roughening of the surface.

Alternative, less preferred arrangements use either solid niobium or solid zirconium. Further alternatives include alloys of tantalum, niobium or zirconium with no more than 20%, and preferably relatively small amounts (no more than 10%), of other elements which should have an atomic number of over 26 so that copper K-alpha radiation does not excite fluorescence. Resistance to nitric acid is important. Suitable alternative alloys include tantalum-zirconium, tantalum-niobium or tantalum-tungsten.

These materials give good shielding, and no problems with fluorescence.

The shutter is also arranged in a particular arrangement, as will now be described with reference to FIGS. 3 to 5.

Figure 3:
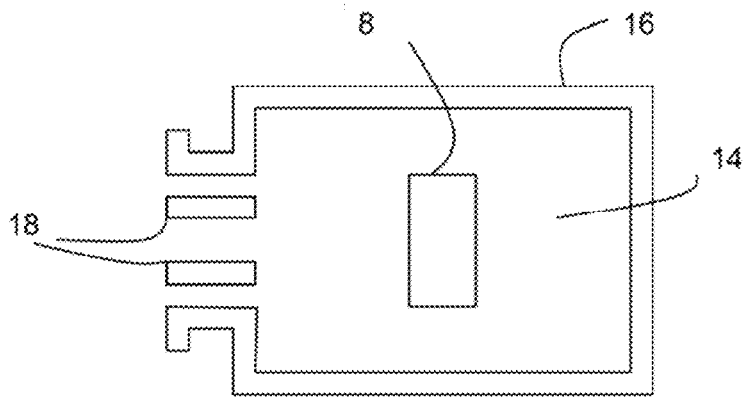
FIG. 3 shows a detail of the arrangements of FIGS. 1 and 2.

FIG. 3 shows a pattern of raised guide members 16, 18. In the arrangement of FIG. 1, these are provided between the inner 13 and outer 11 members at the front face of housing 6. When applied to the arrangement of FIG. 2, the guide members are guide ridges provided on the inner surface 14 of the front face of housing 6. In either case, the guide members surround the opening 8, and include an outer guide member 16 as well as inner guide members 18.

Figure 4:
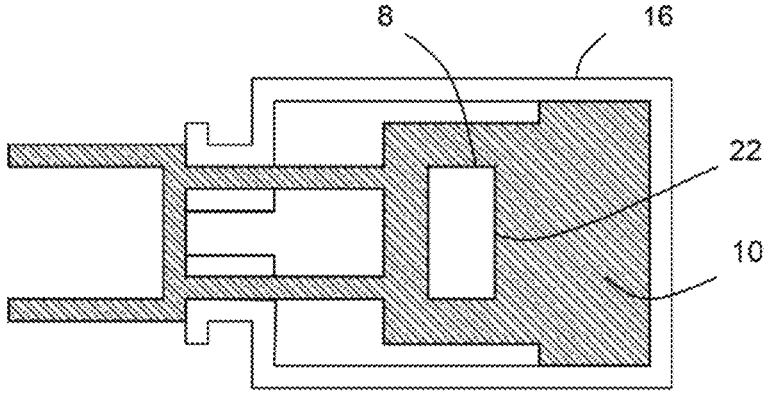
FIGS. 4 and 5 show the shutter in two positions in the FIG. 3 detail.
Figure 5:
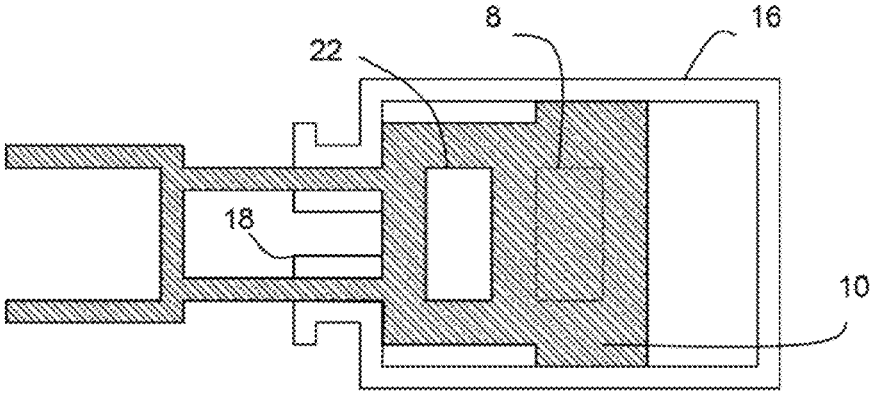

FIGS. 4 and 5 show the shutter 10 in the open position in FIG. 4 and in the closed position in FIG. 5. The shutter does not simply have blocking part, but has a through hole 22 through the shutter. The shutter engages and is guided by the guide members and slides between the two illustrated positions in the plane of the front face of the housing 6. In the closed position (FIG. 5) the shutter 10 completely covers the opening 8 (shown dotted). In the open position (FIG. 4) the through hole 22 is aligned with the opening 8 to allow X-rays through the opening.

Note that in the open position the solid part of the shutter around the opening 8 completely covers the edges of the opening 8.

Referring to FIG. 1, the inventors have realised that corrosion at the inner edge 15 facing the window 4 of the opening 8 in the outer member 11 is a particular problem since by virtue of the geometry X-rays can be highly dense at this point and further any corrosion at this point can impede motion of the shutter. Similarly in the arrangement of FIG. 2, corrosion at the inner edge 15 of the inner face 14 at the opening 8 is a particular problem for the same reasons.

It will therefore be appreciated that the combination of the solid tantalum material with the shutter arranged in this way protects a particular part of the brass material of the housing from X-rays during operation of the X-ray tube with the shutter in the open position as well as in the closed position.

The inventors have realised that the presence of X-rays greatly increases the amount of ionisation in the air and therefore greatly increases the corrosion. Thus, there is a significant advantage in protecting the brass material of the housing during operation by the shutter. In particular, in embodiments, in the open position, during operation, X-rays do not hit or hit to a lesser extent the material of the housing 6 around the opening 4, and in particular are shielded from the inner edge 15 around the opening 8 by the solid material of the shutter around the through hole 22. In the arrangement of FIG. 1, it is true that X-rays can hit the inner edge of the inner member 13 but corrosion at this location is both internal and does not impede motion of the shutter 10. Corrosion at this location is therefore less of an issue for the long term reliability of the device.

Further, in a particularly preferred embodiment, the amount of ionisation is reduced by keeping the air gap between the window 4 and the shutter 10 in the closed position as small as possible. Preferably, the air gap is less than 20 mm, further preferably less than 10 mm, and further preferably less than 5 mm. The goal is to keep the air volume as small as possible in the area of the window 4 and shutter 10, since air that is not present will not ionize. When a conventional shutter opens it creates a relatively large volume of air, the volume where the shutter was in the closed position. This is an extra air supply for the physico-chemical process and hence generates extra ions. There is of course air present in the new design but in the close position no X rays are present in this volume in the arrangement of FIG. 1 now.

Thus, the described embodiment of the invention greatly reduces the problem of corrosion by using a tantalum shutter 10, arranged close to the window 4, the shutter having a through hole 22 so that the shutter around the through hole 22 shields the inner edge 15 around the opening 8 in the housing 6 in use.

Figure 6:
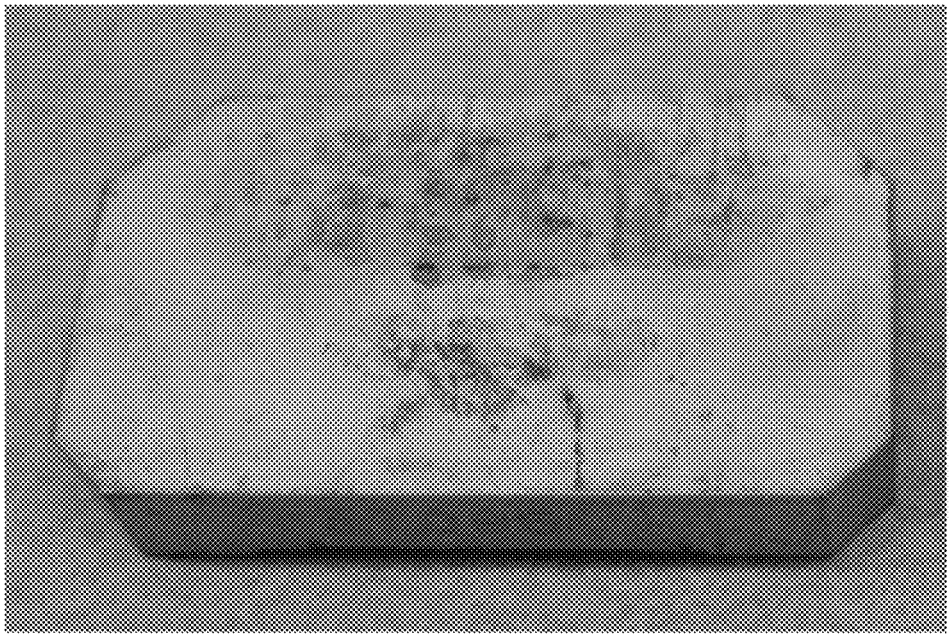
FIG. 6 illustrates a shutter according to a comparative example after exposure to X-rays.
Figure 7:
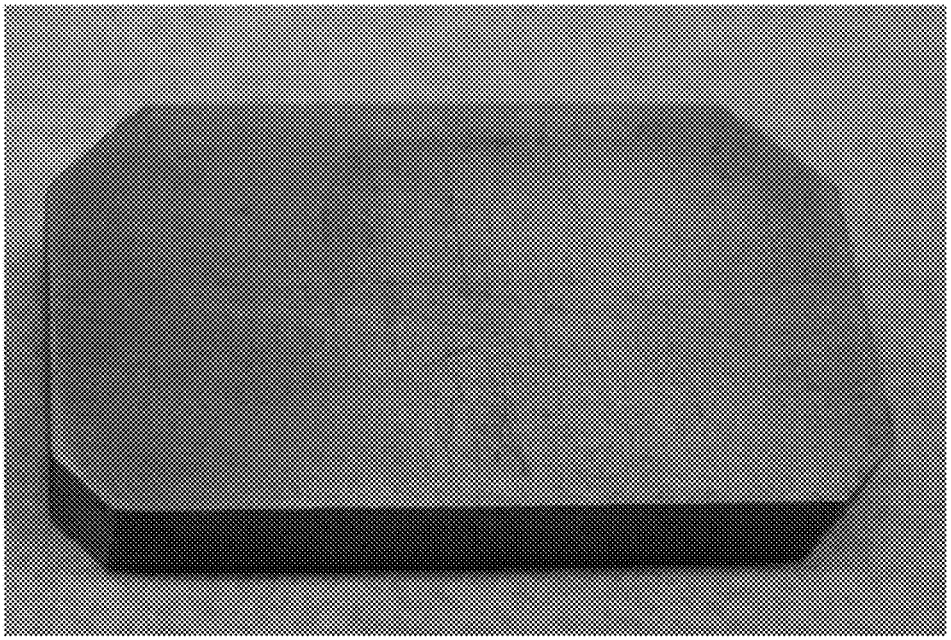
FIG. 7 illustrates a shutter of solid tantalum after exposure to X-rays.

FIGS. 6 and 7 illustrate the improved corrosion performance of tantalum (FIG. 7) compared a tungsten-copper alloy coated with silver and gold (FIG. 6). In this case, the shutter is a conventionally shaped shutter. Both shutters have been exposed to X-rays for the same time. The substantial improvement and reduction in corrosion in FIG. 7 compared with FIG. 6 may be seen.

Figure 8:
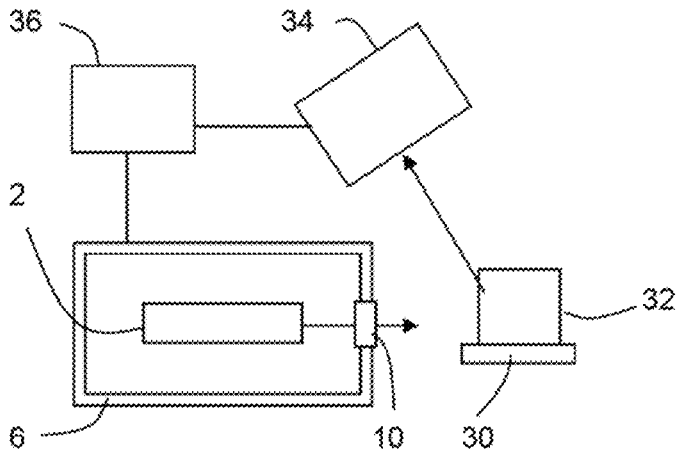
FIG. 8 illustrates an X-ray diffraction apparatus according to the invention.

The shutter arrangements described above are particularly suitable for X-ray diffraction measurements as illustrated in FIG. 8. X-ray diffraction apparatus includes the tube 2, housing 6 and shutter 10 as explained above. A sample stage 30 is used for mounting a sample 32. X-ray detector 34 detects X-rays emitted from a sample 32 on sample stage 30 when X-rays emitted from the tube passing through the opening 8 hit the sample 32. A controller, 36, typically a computer, controls the various components.

The shutter mechanism is particularly suitable in such applications because unlike prior approaches to controlling corrosion, such as Incoloy 825, the shutter arrangement combines corrosion resistance with the avoidance of use of materials that impact on X-ray diffraction measurements. X-ray diffraction apparatus can be used in challenging environments that increases the importance of corrosion resistance.

Figure 9:
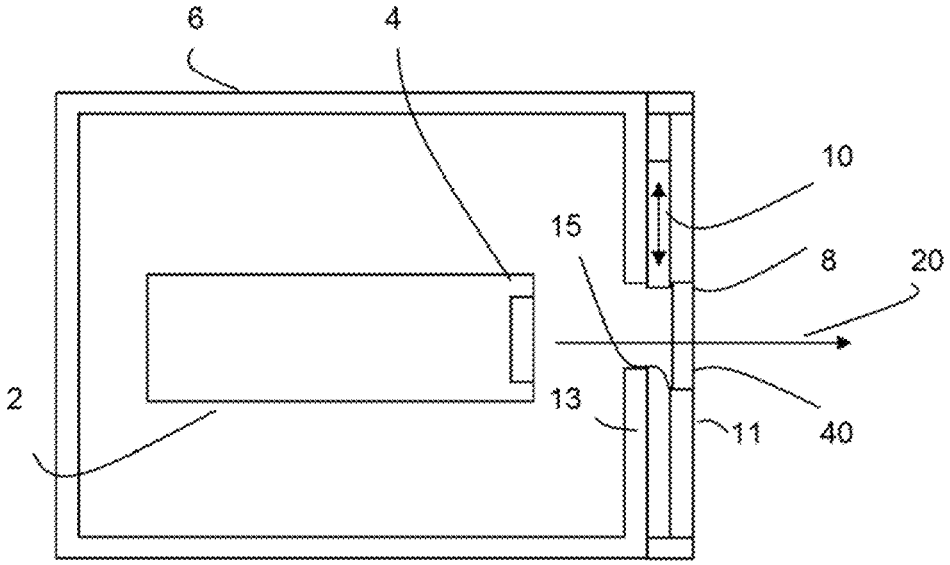
FIG. 9 shows a schematic diagram of a yet further embodiment of the invention.

In an alternative embodiment of the shutter mechanism, illustrated in FIG. 9, the outer member 11 at the front of the housing 6 is sealed with an X-ray transparent window 40. With the shutter 10 in the open position, this window 40 prevents a fresh air supply from the environment to enter the unit, further reducing corrosion.

Although FIG. 9 is based on the approach of FIG. 1, an X-ray transparent window may also be used in combination with the arrangement of FIG. 2.

The skilled person will realise that changes may be made to the embodiments described above. For example, the housing need not be made of brass alone, but other materials such as lead or tantalum may be introduced.

Further, the solid tantalum need not be 100% pure, but impurities may be present.

In some embodiments, niobium or zirconium can replace the tantalum. Alloys with typically at least 80%, preferably 90%, of tantalum, niobium or zirconium may be used.

The invention claimed is:

1. A shutter arrangement, comprising:

an opening in an housing for allowing X-rays to pass through the opening from an inner face to an outer face of the X-ray housing, the X-ray housing being substantially opaque to X-rays; and a shutter movable between a blocking position adjacent to the opening where it blocks the opening and an open position where it allows X-rays to pass through the opening;

wherein the shutter is of tantalum, niobium or zirconium, or an alloy containing at least 80% of one of these elements and a further metal/element; and wherein the shutter is a block having a through hole through the block, the hole being aligned with the opening when the shutter is in the open position to allow X-rays to pass through the hole and the shutter blocking the opening when the shutter is in the blocking position.

2. A shutter arrangement according to claim 1 wherein the through hole through the block is sized to completely cover edges of the opening when the shutter is in the open position.

3. A shutter arrangement according to claim 1 wherein the shutter is arranged to slide laterally across the opening in the plane of the opening between the blocking position and the open position.

4. A shutter arrangement according to claim 1 wherein the X-ray housing contains an X-ray tube, the X-ray tube having a window for allowing X-rays to pass out of the tube, wherein the shutter in the blocking position is at a distance of not more than 20 mm from the window in the X-ray tube.

5. A shutter arrangement according to claim 4, wherein the shutter in the blocking position is at a distance of not more than 10 mm from the window in the X-ray tube.

6. A shutter arrangement according to claim 1 wherein the housing is of brass.

7. A shutter arrangement according to claim 1 wherein the shutter consists essentially of tantalum.

8. A shutter arrangement according to claim 1 wherein the shutter consists of an alloy of at least 80% tantalum, niobium or zirconium and no more than 20% of at least one other metal/element having an atomic number of over 26.

9. A shutter arrangement according to claim 1 further comprising an X-ray transparent window sealing the opening.

10. A shutter arrangement, comprising an opening in an housing for allowing X-rays to pass through the opening from an inner face to an outer face of the X-ray housing, the X-ray housing being substantially opaque to X-rays; and a shutter movable on the inner face of the X-ray housing between a blocking position adjacent to the opening where it blocks the opening and an open position where it allows X-rays to pass through the opening;

wherein the shutter is of tantalum, niobium or zirconium, or an alloy containing at least 80% of one of these elements and a further metal/element.

11. A shutter arrangement according to claim 10, wherein the shutter is a block having a hole through the block, the hole being aligned with the opening when the shutter is in the open position to allow X-rays to pass through the hole and the shutter blocking the opening when the shutter is in the blocking position.

12. A shutter arrangement according to claim 11 wherein the hole through the block is sized so that all edges of the opening are completely covered when the shutter is in the open position.

13. A shutter arrangement according to claim 10 wherein the shutter is arranged to slide laterally across the opening in the plane of the opening between the blocking position and the open position.

14. A shutter arrangement according to claim 10 wherein the X-ray housing contains an X-ray tube, the X-ray tube having a window for allowing X-rays to pass out of the tube, wherein the shutter in the blocking position is at a distance of not more than 20 mm from the window in the X-ray tube.

15. A shutter arrangement according to claim 10 wherein the housing is of brass.

16. A shutter arrangement according to claim 10 wherein the shutter consists essentially of tantalum.

17. A shutter arrangement according to claim 10 wherein the shutter is of an alloy containing tantalum, niobium or zirconium and another metal/element of atomic number above 26.

18. A shutter arrangement according to claim 10 further comprising an X-ray transparent window sealing the opening.

19. X-ray diffraction apparatus comprising:

an X-ray tube having a window;

a housing around the X-ray tube, the housing having an opening in the housing for allowing X-rays to pass through the opening from an inner face to an outer face of the X-ray housing, the X-ray housing being substantially opaque to X-rays; and a shutter movable between a blocking position adjacent to the opening where it blocks the opening and an open position where it allows X-rays to pass through the opening;

a sample area for mounting a sample; and an X-ray detector for detecting X-rays emitted from the sample in the sample area;

wherein the shutter is of tantalum, niobium or zirconium, or an alloy containing at least 80% of one of these elements and a further metal/element; and wherein the shutter is a block having a hole through the block, the hole being aligned with the opening when the shutter is in the open position to allow X-rays to pass through the opening and the shutter blocking the opening when the shutter is in the blocking position.

20. X-ray diffraction apparatus according to claim 19 wherein the hole through the block is sized to completely cover edges of the opening when the shutter is in the open position.

* * * * *